United States Patent [19]

Lemmer

[11] 4,229,719

[45] Oct. 21, 1980

[54] CONTACTOR

[75] Inventor: Helmut Lemmer, Marienheide-Kalsbach, Fed. Rep. of Germany

[73] Assignee: Starkstrom Schaltgeraetefabriken Sprindler Deissler GmbH & Co. KG, Marienheide-Roth, Fed. Rep. of Germany

[21] Appl. No.: 926,339

[22] Filed: Jul. 20, 1978

[30] Foreign Application Priority Data

Jul. 21, 1977 [DE] Fed. Rep. of Germany ..... 2732963

[51] Int. Cl.[2] ..... H01H 67/02

[52] U.S. Cl. ..... 335/132; 335/197

[58] Field of Search ..... 335/132, 133, 135, 197; 339/272 R, 272 A, 272 UC

[56] References Cited

U.S. PATENT DOCUMENTS

| | | | |
|---|---|---|---|
| 3,246,283 | 4/1966 | Huska | 339/272 UC |
| 3,320,561 | 5/1967 | Mobarry | 339/272 R X |
| 3,504,311 | 3/1970 | Mullen et al. | 335/132 |
| 4,006,323 | 2/1977 | Nelson et al. | 339/272 A X |
| 4,117,429 | 9/1978 | Streich et al. | 335/132 |

FOREIGN PATENT DOCUMENTS

| | | | |
|---|---|---|---|
| 1250532 | 9/1967 | Fed. Rep. of Germany | 335/132 |

*Primary Examiner*—George Harris

*Attorney, Agent, or Firm*—Michael J. Striker

[57] ABSTRACT

A contactor comprises a contact system arranged in a housing with a magnet system activating the contact system. The housing, at the end thereof remote from the side of the housing at which the housing is mounted in a switch box, is closed off by a cover. The contact system comprises contact bars with contact terminal screws and stationary contact pieces, and jointly activatable bridging members having movable contact pieces and operating as normally closed and/or normally open switches. The contact bars with their contact terminal screws are arranged displaced relative to one another in planes having differing spacings from the end of the housing at which the housing is mounted on a switch box, in such a manner that each contact terminal screw is freely accessible, even after all wiring has been connected on. This makes possible direct access to connections at the terminal screws of the more deep-lying planes, and makes it possible to wire on in sequences other than beginning with the plane closest to the mounting plane.

7 Claims, 7 Drawing Figures

CONTACTOR

Figure 1:
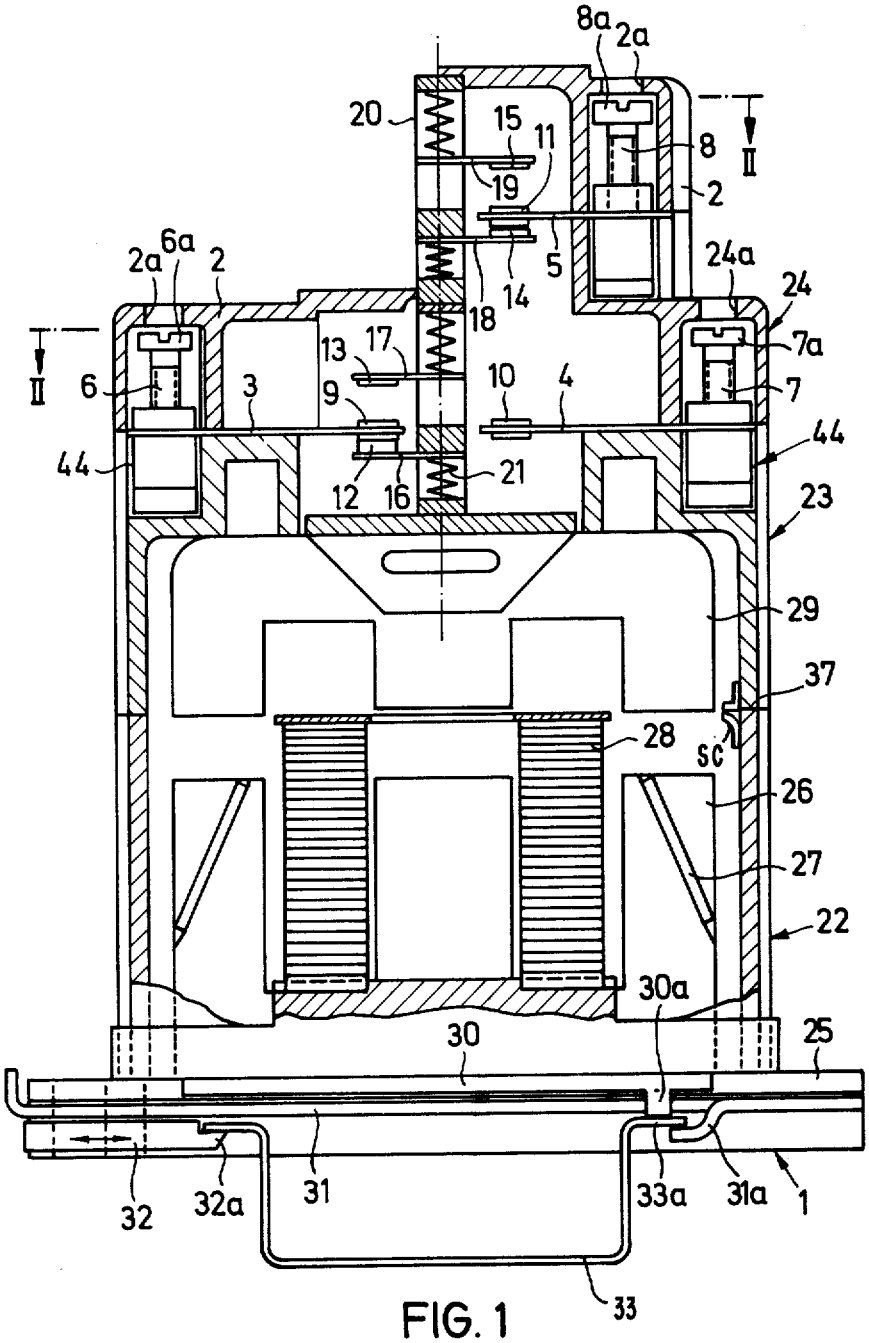

The invention concerns a contactor, in particular a power or auxiliary contactor, with a contact system provided in a housing and a magnet system activating the contact system; the housing, at the end thereof remote from the mounting side of the housing, is closed off by a cover; furthermore, the contact system comprises contact bars with contact terminal screws and stationary contact pieces and also jointly activatable bridging members with movable contact pieces operating as normally closed and/or normally open switches.

Contactors of the aforementioned type are known in practice in numerous designs. With all of them, a considerable disadvantage has resulted, which is to be seen in the fact that the possibilities for connecting on the wiring are very bothersome. In practice, contacts are usually installed in densely arranged rows in switch boxes, with the mounting planes extending vertically, usually with the intermediary of U-shaped mounting rails. The contactors are in this event in general inserted densely one after the other in horizontal rows, so that the connecting conductors can extend to above and to below and come together in channels intermediate the rows of contactors. With all hitherto known contactors of the type defined above, the terminals, especially the terminal screws, for the wiring are located one above the other, i.e., in planes perpendicular to the mounting plane of the switch box, when the contact terminal screws are arranged in the contactor in two or more planes which extend parallel to the mounting plane. In practice, it is accordingly imperative to first perform the wiring of those contact terminal screws which are located in the plane closest to the mounting plane. Only thereafter can one perform the wiring of the contact terminal screws in the plane(s) which are more greatly spaced from the mounting plane of the switching box.

A factory-prepared and completely wired switching box of such type is subjected to considerable shaking during transport to the place of installation, which makes it imperative that after installation all contact connections be checked with respect to firmness and contact reliability. In practice, this has proved extraordinarily troublesome, because the wiring of the contact terminal screws of the outer planes makes difficult the access to the contact terminal screws of the inward plane or planes located therebeneath. Accordingly, when very high demands are involved relative to security of contact, one is forced to disengage the wiring of the outer planes, in order to be able to release the contact terminal screws located therebeneath.

The present invention has the object to provide a contactor, which makes possible connecting on of the wiring with simple manipulation, and with which: the wiring of the upper and of the lower contact terminal screws, or vice versa, can be performed, without necessitating an increase of the width of the contactor, which in practice is pregiven and determined in accordance with the number of poles.

The object in question can be achieved according to the invention in that: the contact bars with their contact terminal screws are arranged displaced relative to one another in planes which have differing spacing from the end of the housing which serves for mounting, in such a manner that each contact terminal screw is freely accessable when the wiring is present. In this way, besides the simple manipulation when connecting on the wiring, there is also achieved the further advantage that instead of performing the wiring manually it can also be performed by machine if desired.

Advantageous features of the invention are set forth in the dependent claims.

Figure 2:
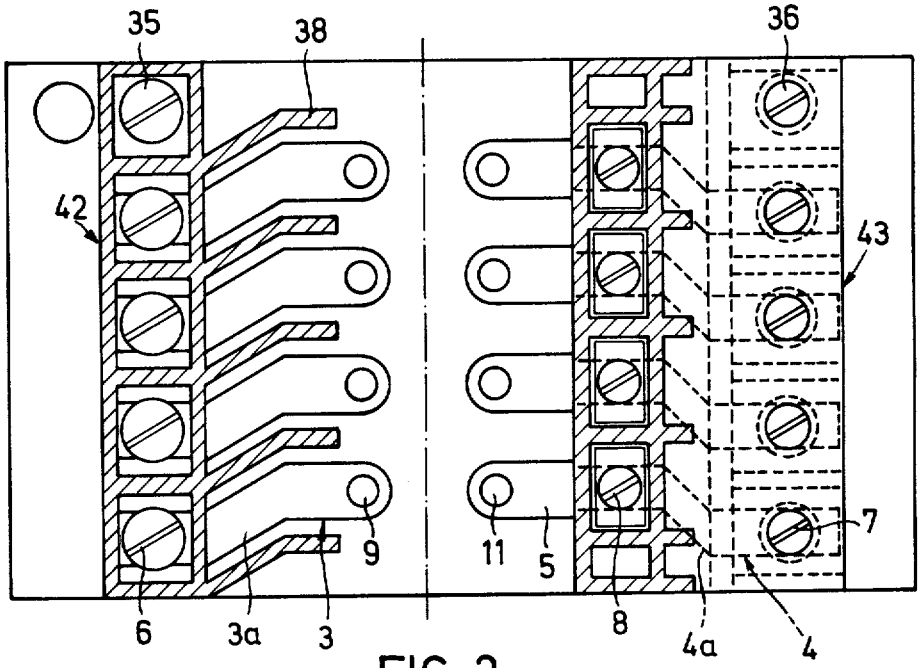
Figure 3:
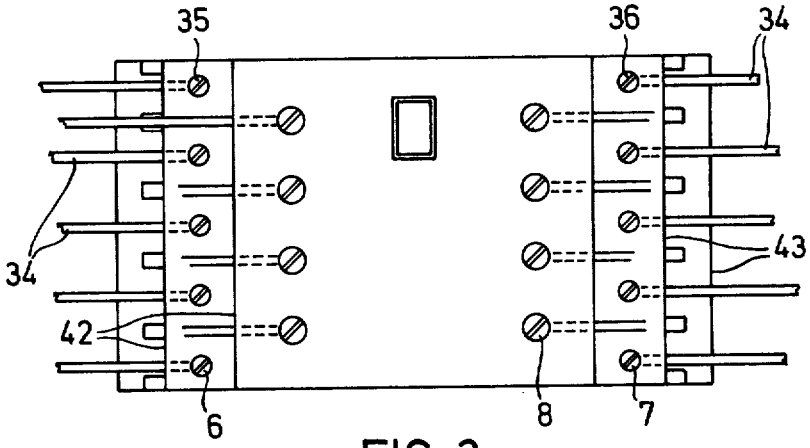

In the drawing there is schematically depicted an exemplary embodiment of the invention, and in particular there is shown:

FIG. 1 a longitudinal section through a contactor which can be altered with respect to the number of poles, FIG. 2 a section through the latter along section line II—II, FIG. 3 a top view looking down on a contactor with an illustration of the location of the wiring and FIGS. 4 to 7 construction details.

The invention is preferably used at up to 7.5 KW in the case of power contactors, as well as at up to 20 A persisting current in the case of auxiliary contactors, and specifically in a selectable manner for four and eight contacts. The contactor comprises a housing made of plastic, in which are provided a contact system as well as a magnet system activating the contact system; the housing, at the end thereof remote from the mounting side 1, is closed off by a cover 2; the contact system comprises contact bars 3, 4 and 5 with contact terminal screws 6, 7 and 8 and with stationary contact pieces 9, 10 and 11. Furthermore belonging to the contact system are movable contact pieces 12, 13, 14 and 15, which are each mounted on a respective bridging member 16, 17, 18 and 19, only half of each bridging member shown in FIG. 1; these bridging members are, in conventional manner, inserted in a common bridge-member carrier 20, and specifically with the intermediary of springs 21 in corresponding recesses. The contacting bridges can be so installed as to operate either normally closed or normally open.

The housing, which encloses the aforementioned contact system, is divided into planes extending parallel to the housing mounting plane; and specifically, this housing comprises a lower housing part 22, arranged above the latter a housing part 23 and the cover 2 or, if an intermediate switch holder module is provided, furthermore comprises a housing part 24. The contactor of FIG. 1 accordingly can, with a few manipulations, be converted from a four-pole contactor into an eight-pole contactor, or vice versa. The lower housing part 22 with base part 25 encircles the major part of the magnet system, and specifically, the inserted core 26 with short-circuiting rings 27 and coil 28 as well as the vertically movable armature 29; the latter, however, upon removal of the housing parts 23, 24, and when in its lowermost setting, projects upwardly to such an extent that one can easily lift it up and remove it as well as the remaining parts of the magnet system out of the housing. The armature 29 is connected with the bridging-member holder 20 in a manner suitable for joint activation of the contacts.

In order to absorb the impact of armature 29 upon the core 26, relative to the mounting wall of the non-illustrated switch box, a rubber plate 30 is provided between core 26 and a mounting plate 31. In accordance with FIG. 1, at the left end of the mounting plate 31 there is provided a slider 32 shiftable in the direction of the indicated arrows; in the rightward position of slider 32, its nose **32*a* engages behind the edge of a U-shaped mounting rail 33 of the switch box, while the oppositely located edge 33*a* of the U-profiled rail can, for purposes of insertion, be slid in under a displaced part 31***a* of the mounting rail 31. A transversely extending, ledge-like projection 30*a* of the rubber plate 30 presses from above against the edge of the U-profile and prevents lateral shifting of the contactor on the profile. The assembling together of the aforedescribed housing parts is performed by means of non-illustrated screws.

Especially FIGS. 2 and 3, in conjunction with the rightward part of FIG. 1, illustrate that the contact bars 4, 5 with their contact terminal screws 7, 8 are arranged offset relative to each other in planes of differing distance from the end 1 of the housing which serves for mounting, in such a manner that, when wiring 34 is connected on, each contact terminal screw 7, 8 is freely accessible.

Preferably, the contact bars are arranged in two planes extending spaced from one another, with the contact bar 5 at the plane closer to the cover being selected shorter than the contact bar 4 of the other plane. The contact bars 3 and 4 are within their planes formed in such a manner that the respective stationary contact pieces 9, 10 or 11 of the contact bars provided in the two planes are located in respective pairs normal to the housing mounting plane 1. Advantageously, the contact bars of at least one plane—in the embodiment according to FIG. 2, to long contact bars 3, 4—are provided with a respective slanting part 3*a* or 4*a*.

In the exemplary embodiment according to FIGS. 1 to 3, the contactor is selected for eight-pole operation. In FIGS. 2 and 3 one will note two further contact terminal screws 35 and 36. These are the contact terminal screws for the coil 28 of the magnet system, and specifically these contact terminal screws are arranged in the region of the plane of the contact bars 3, 4 or of their contact terminal screws 6, 7. In order to establish a current-carrying connection between, on the one hand, the coil 28 and, on the other hand, these contact terminal screws 35, 36, there are provided at the juncture plane 37 (FIG. 1), between the housing part 22 of the magnet system and the housing part 23 of the contact system, non-illustrated spring contacts; the latter mainly comprise two parts, one part on the bottom side of housing part 23 and another part on the top side of the housing part 22. When these two housing parts are connected together by means of screws, the two spring contacts press against each other and establish a current-carrying connection. It will be understood that there are connected to opposite sides of these spring contacts electrical conductors which interiorly of the housing parts lead, on the one hand, to the coil and, on the other hand, to the contact terminal screws 35, 36.

Figure 4:
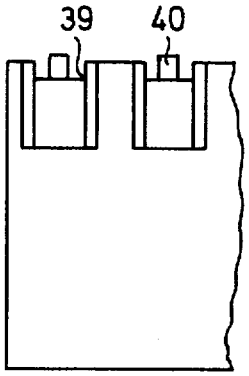
Figure 5:
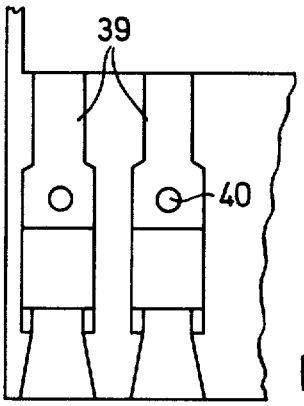
Figure 6:
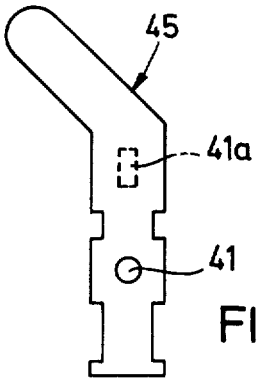
Figure 7:
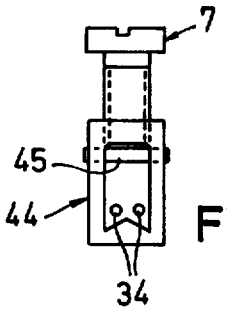

The contact bars, 3, 4 and 5 are separated from one another by separating walls 38 for safety during operation, as shown in FIGS. 4 and 5 are secured by clamping action in open grooves 39 of corresponding housing wall parts. Additionally, they are held in place by attaching-on the housing part 24, which latter contains contact system and as described above serves as a switch holder module, or they are held in place by the cover 2. To increase the clamping action, there is advantageously provided in each groove a projecting pin 40 and in each contact bar a corresponding opening 41 or in a different form 41*a* (FIG. 6).

It is particularly significant that there are provided, in the switch holder module 24 and in the cover 2, passages 2*a*, 24*a* which extend perpendicular to the housing mounting plane 1 and are associated with the contact terminal screws 6, 7, 8 for the insertion of the shaft of a screwdriver. Advantageously, these passages are designed as cylindrical openings, with the diameter of the openings being designed smaller than that of the head 6*a*, 7*a*, 8*a* of the contact terminal screws.

The contact terminal screws 6, 7, 8 and 35, 36 cooperate with respective clamps 44 (FIG. 7), which latter open towards two oppositely located side faces 42, 43 of the switch holder module 24, so that the connecting conductors 34 can be selectably inserted singly or multiply. Advantageously, the clamps are provided with self-opening clamping plates. In the exemplary embodiment of FIG. 7, the clamp 44 comprises a mainly rectangular frame. When the ends of the connecting conductors 34 are inserted into this open frame and the contact terminal screw 7 is activated, then the lower end of the screw presses upon the stationary contact bar 45 corresponding to the contact bars 3, 4 and 5, so that the frame of clamp 44 with the connecting conductors moves upwards until such time as the connecting conductors are fixedly clamped.

Instead of the aforedescribed clamps, there also can be provided other screw connectors with simple machine screws or solder connections or flat plug connectors for securing the connecting conductors.

As will be clear from the preceding description and the drawing, the inventive contactor can in a simple way be converted over to other practical applications, and specifically by exchanging the contact system with one or plural switch holder modules for another contact system, with the contact systems containing mechanical and/or electronic components as desired.

The embodiments of the invention in which an exclusive property or privilege is claimed are defined as follows:

1. A contactor, comprising, in combination, a housing having a mounting side for mounting the housing on a switchboard or the like, the housing being provided with a housing cover section at the side thereof remote from the mounting side, a contact system and a magnet system accommodated within the housing, the magnet system activating the contact system, the contact system comprising contact bars with contact terminal screws and stationary contact pieces and jointly activatable bridging members having movable contact pieces cooperating with the stationary contact pieces to form relay switches, the contact terminal screws comprising at least a first row of contact terminal screws located in a first plane parallel to and spaced a first distance from the mounting side of the housing and a second row of contact terminal screws located in a second plane parallel to and spaced a different second distance from the mounting side of the housing, the contact terminal screws of the first row, when viewed in the direction normal to the first and second planes, being offset relative to the contact terminal screws of the second row in the direction in which the first and second rows extend.

2. A contactor as defined in claim 1, the first row of contact terminal screws being furthermore spaced from the second row of contact terminal screws in the direction parallel to the mounting side of the housing.

3. A contactor as defined in claim 1, the contact bars comprising first contact bars connected to respective ones of the first contact terminal screws, the stationary contact pieces of the first contact bars being first stationary contact pieces, and second contact bars connected to respective ones of the second contact terminal screws, the stationary contact pieces of the second contact bars being second stationary contact pieces, at least some of the contact bars comprising slanting portions which slant such that pairs of corresponding first and second stationary contact pieces are located on common normals to the mounting side of the housing despite the offset between the first and second rows of contact terminal screws.

4. A contactor as defined in claim 1, the magnet system of the contactor including a winding and winding contact terminal screws connected to the winding, the first row of contact terminal screws being located closer to the mounting side of the housing than the second row of contact terminal screws, the winding contact terminal screws being located as part of the first row of contact terminal screws likewise offset relative to the contact terminal screws of the second row of contact terminal screws.

5. A contactor as defined in claim 4, the housing comprising a plurality of housing sections joined together at housing section junction planes which are parallel to the mounting side of the housing, one housing section accommodating the contact system and another housing section accommodating the magnet system, and furthermore including spring contacts located at the junction plane between the magnet system housing section and the contact system section for use in electrically connecting the winding of the magnet system to the winding contact terminal screws.

6. A contactor as defined in claim 5, at least one of the housing sections being provided with grooves which accommodate the contact bars with clamping action, each groove furthermore including a projecting pin and each contact bar being provided with an opening through which the respective projecting pin extends for securely holding the contact bar in correct position.

7. A contactor as defined in claim 1, each contact terminal screw being provided with a clamp having two faces facing in opposite respective directions for clamping a one- or two-conductor lead in conductive engagement with the respective contact terminal screw.

* * * * *